United States Patent [19]

Ydstie

[11] 4,115,108

[45] Sep. 19, 1978

[54] MATTE SMELTING

[75] Inventor: Birger Leif Ydstie, Blommenholm, Norway

[73] Assignee: Elkem-Spigerverket A/S, Oslo, Norway

[21] Appl. No.: 747,216

[22] Filed: Dec. 3, 1976

[30] Foreign Application Priority Data

Dec. 4, 1975 [NO] Norway ..... 754091

[51] Int. Cl.[2] ..... C21C 5/52

[52] U.S. Cl. ..... 75/11; 75/12

[58] Field of Search ..... 75/10–12, 75/72–74

[56] References Cited

U.S. PATENT DOCUMENTS

| | | | |
|---|---|---|---|
| 2,557,650 | 6/1951 | Gilliland | 75/73 |
| 3,326,672 | 6/1967 | Worner | 75/73 |
| 3,664,828 | 5/1972 | Worner | 75/73 |
| 3,832,163 | 8/1974 | Themelis | 75/72 |

*Primary Examiner*—Peter D. Rosenberg

*Attorney, Agent, or Firm*—Eyre, Mann, Lucas & Just

[57] ABSTRACT

Improvements in matte smelting are disclosed. A circular furnace is formed having a concave bottom, the radius of curvature of the bottom being no greater than the diameter of the circular furnace. The matte level is controlled to cover not more than half of the concave surface bottom. Advantageous positioning of the electrodes, tapping holes, feed chutes and the like are also disclosed.

5 Claims, 2 Drawing Figures

MATTE SMELTING

Figure 1:
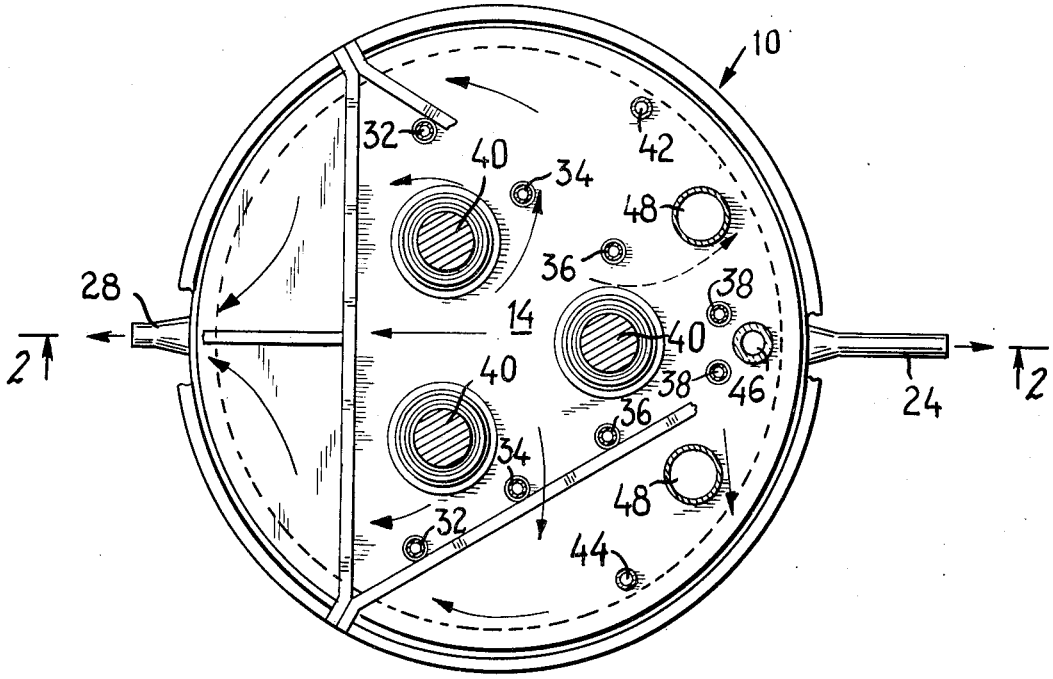

The present invention relates to matte smelting and to improvements therein, especially in the area of in situ slag refining. The present invention is concerned with matte smelting in an electric furnace. The electric furnace of the present invention is circular and has submerged electrodes.

Matte smelting is an old and well known process. In matte smelting, concentrates are fed to the smelting furnace. These concentrates are sulfidic minerals, typically dried, partially roasted or pelletized copper or nickel concentrates. The concentrates will also include iron.

The process in the smelting furnace is primarily directed to the separation of the iron from the more valuable elements such as copper, nickel, noble metals and the like. This is accomplished by slagging the iron content, typically by the addition of a material such as quartz. Two molten phases are thus formed, the oxide phase containing predominantly iron and the sulfide phase or matte which is predominantly the more valuable elements. The matte will collect on the bottom of the furnace and can be tapped from the bottom portion while the slag will be the upper phase and is tapped at a higher level on the furnace.

The matte and the slag phases have a certain degree of solubility in each other. This solubility is dependent upon such factors as temperature, the oxygen potential of the slag and the concentration of sulfides in the matte. A low degree of matte, i.e., a matte with high iron sulfide content, will give a lower loss of valuable elements to the slag phase. However, a high degree of matte is beneficial in the subsequent convertor step. Because of these balancing interests, there is usually a compromise to try to achieve an optimum ratio. This optimum ratio will be considerably higher than the lowest degree of matte attainable.

Because of the somewhat elevated degree of matte, typical matte processes involve recovery of dissolved sulfides from the slag phase after it has been removed. This is normally accomplished in a special slag refining furnace. The applicant has now discovered that the need for this special refining furnace to recover dissolved sulfides from the slag phase can be eliminated by improvements in the matte process to permit reduction of the oxygen potential in the slag phase while at the same time maintaining a relatively high degree of matte in the furnace. These benefits are achieved by employing a circular furnace with a concave bottom. The applicant has discovered that employing a furnace with a concave bottom and with the matte phase covering no more than about half of the bottom results in favorable movement in the furnace pot so that a higher degree of slag refining can be accomplished in the furnace than is otherwise normally attainable because of the necessary process limitations for having a high enough degree of matte for the subsequent convertor step. In addition to the concave bottom of the furnace, improvements in positioning of the tapping holes, electrodes and feed chutes with respect to each other are disclosed.

Figure 2:
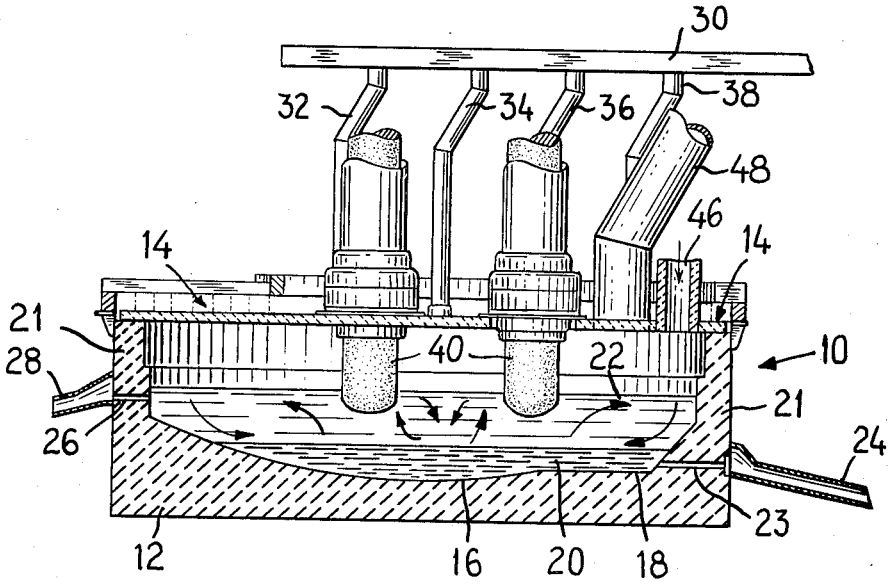

These and other advantages of the present invention may be more fully understood with respect to the drawings in which:

FIG. 1 is a top view of a suitable apparatus according to the present invention; and FIG. 2 is a section view through line 2—2 of FIG. 1.

Referring now to the figures, there is shown a circular smelting furnace 10 having a lining 12 and a roof 14. In accordance with the present invention, the bottom 16 of the furnace is made strongly concave. By strongly concave it is meant that the radius of curvature of the bottom of the furnace is smaller than the diameter of the circular furnace pot. It will be appreciated that as a practical matter, the radius of curvature cannot be smaller than the radius of the circular furnace pot. It will also be appreciated that minor breaks in the curve such as that shown at 18 to facilitate tapping of the matte phase are within the contemplation of the present invention.

The matte 20 collects on the bottom of the furnace while the slag 22 floats on the matte. The matte preferably covers no more than about one-half of the furnace bottom 16 in order to aid in movement of the bath as described more fully hereinafter. The liquid matte is removed from the furnace pot through the wall 21 thereof by means of tapping hole 23 and associated spout 24 while slag is removed through tapping hole 26 and associated spout 28.

Transport chute 30 distributes the charge to chutes 32, 34, 36, and 38. The charge is distributed in the central portion of the furnace about the electrodes 40 which are disposed in a triangular configuration as shown. In operation, heat is supplied to the slag through the electrodes 40 submerged therein. Because of a stronger development of gas in the energy intensive areas around the electrodes than in other areas, there will be vertical upwards movement in the bath in the vicinity of the electrodes. In these zones, the smelting of the charge will take place at a higher rate than in the circumferential zones. The result of this will be that the flow of slag on the surface of the slag phase will be in a direction towards the circumference of the furnace pot while the slag portion at the interface between the slag and matte phases will flow towards the electrodes in the center of the furnace. Because the slag tapping hole 26 is located at the furthest point away from the triangular arrangement of electrodes, i.e., opposite the middle of a wall of the triangle formed by the electrodes, slag flow will tend to follow the circumference or periphery of the furnace pot on its way towards the slag tapping hole. This is shown in the figures by arrows which indicate the direction of flow of the slag.

Since the slag phase is quite well separated from the matte phase in the circumferential zones of the furnace due to the bath flow caused by the concave bottom of the furnace, reducing agents such as pyrite or carbon can be added to the slag to further refine the slag in situ and thereby obviate the need for a special slag refining furnace. Charging chutes 42 and 44 located in the outer peripheral portion of the furnace 10 and in that half of the pot remote from the slag tapping hole 26 are used for supplying the reducing agent.

Matte material removed through tapping hole 23 is subsequently conveyed to a convertor for further processing. In the further processing, and as is well known in the art, a convertor slag is obtained. This convertor slag is much richer in valuable metal sulfides than the furnace slag removed through tapping hole 26 and for this reason the convertor slag is returned to the smelting furnace. In accordance with one aspect of the present invention, the convertor slag is returned through chute 46 which is positioned opposite the furnace slag tapping hole 26. Because of this arrangement, the convertor slag will be mixed with the furnace slag along the circumference of the furnace and it will therefore be purified as it flows towards the slag tapping hole. Gas may suitably be removed from the furnace through gas pipes 48 positioned in the cover 14 of the furnace.

It will be understood that the claims are intended to cover all changes and modifications of the preferred embodiment of the invention, herein chosen for the purpose of illustration, which do not constitute departure from the spirt and scope of the invention.

What is claimed is:

1. A matte smelting process for the separation of iron from one or more other metal values said process comprising:

(a) forming a matte phase and a slag phase in the furnace pot of an electric arc furnace, said furnace pot being circular and having a sidewall and a bottom, said bottom being substantially concave and a substantial portion of the concave bottom having a radius of curvature no greater than about the diameter of the furnace pot; and (b) controlling the operation of the furnace so that the matte phase covers no more than about one-half of the surface of the concave bottom of the circular furnace pot.

2. The process of claim 1 further including the step of adding reducing agent to the said slag phase.

3. The process of claim 1 wherein the other metal values include at least one of copper or nickel.

4. The process of claim 1 wherein raw material is supplied to the central part of the furnace and reducing agents are supplied to the circumferential zones of the furnace.

5. The method of claim 1 wherein slag is returned to the matte smelting process from a subsequent convertor step.

* * * * *